United States Patent [19]

Coleman-Kammula

[11] Patent Number: 4,857,588

[45] Date of Patent: Aug. 15, 1989

[54] PROCESS FOR THE PREPARATION OF HYDROCARBYL-GRAFTED CELLULOSE FIBERS

[75] Inventor: Seetha Coleman-Kammula, Amsterdam, Netherlands

[73] Assignee: Shell Oil Company, Houston, Tex.

[21] Appl. No.: 69,136

[22] Filed: Jul. 2, 1987

[30] Foreign Application Priority Data

Jul. 2, 1986 [GB] United Kingdom ..... 8616164

[51] Int. Cl.[4] ..... C08F 283/02; C08F 283/04

[52] U.S. Cl. ..... 525/54.2

[58] Field of Search ..... 525/54, 2

[56] References Cited

U.S. PATENT DOCUMENTS

| | | | |
|---|---|---|---|
| 2,181,906 | 11/1937 | Miller et al. | 536/63 |
| 3,351,635 | 11/1967 | Kollar | 549/529 |
| 3,492,082 | 1/1970 | Hackensack | 8/120 |
| 4,540,742 | 9/1985 | Okamoto | 527/300 |

FOREIGN PATENT DOCUMENTS 1543039 3/1979 United Kingdom .

OTHER PUBLICATIONS

Formation and Structure of Sodium Cellulosates in Relation to Physical Properties of Cellulosic Fibers; R. K. Toner; B. Z. Kamich, Textile Research Journal, vol. 38, Jan. to Dec. 1968, pp. 599–605.

R. P. Quirk, Wei-Chih Chen; Functionalization of Polymeric Organolithium Compounds. Carbonation; Macromolecular Chem. & Phys.; vol. 183, No. 9, pp. 2071–2076.

*Primary Examiner*—Morton Foelak
*Assistant Examiner*—Nathan M. Nutter
*Attorney, Agent, or Firm*—Dean F. Vance

[57] ABSTRACT

Hydrocarbyl-grafted cellulose fibers and a process for the preparation of hydrocarbyl chain-grafted cellulose fibers comprising the steps of contacting cellulose fibers wherein in the range of from 0.25 to 33.3% of the hydroxyl groups have been converted into the corresponding alkali metal oxy groups, with an organic compound comprising a hydrocarbyl chain having a molecular weight of at least 150 and wherein said chain carries an electrophylic functional group, at a temperature in the range of from 20° to 150° C.

15 Claims, No Drawings

PROCESS FOR THE PREPARATION OF HYDROCARBYL-GRAFTED CELLULOSE FIBERS

BACKGROUND OF THE INVENTION

The present invention relates to a process for the preparation of hydrocarbyl chain-grafted cellulose fibers, to the hydrocarbyl chain-grafted cellulose fibers made by said process and to their use.

SUMMARY OF THE INVENTION

The preparation of polymer-grafted cellulose, including certain classes of polymer-grafted cellulose fibers of fibrous materials, has been described in U.S. Pat. No. 3,492,082. These polymer-grafted cellulose products are prepared by converting hydroxyl groups of cellulose into hydroperoxide groups via the formation of an intermediate sulfonate ester group. Subsequently, the hydroperoxide group-containing cellulose is reacted with a reactive monomer to yield a polymer-grafted cellulose material. This method for the preparation of polymer-grafted cellulose materials has the inherent disadvantage in that the chain length of the polymer grafts may vary considerably, coupled with the concern that at anytime, there is the possibility that a non-grafted polymer species could be formed, e.g. as a result of chain transfer reactions. A further disadvantage is that the types of polymer grafts as taught in U.S. Pat. No. 3,492,082 are restricted to compositions based on monomers which have the ability to polymerize in the presence of a hydroperoxide type of free-radical initiator. The preparation of polymer-grafted cellulose materials thus leaves room for improvement to overcome these disadvantages. Therefore, the present invention concerns an improvement in the preparation of grafted cellulose materials of the type described in U.S. Pat. No. 3,492,082 patent.

The present invention relates to a method for grafting a "ready-made" hydrocarbyl chain of relatively high molecular weight, carrying a functional group, onto a fibrous cellulose derivative, while maintaining the fiber structure of the cellulose material.

The present invention also relates to a process for the preparation of hydrocarbyl chain-grafted cellulose fibers, which comprises: contacting cellulose fibers wherein the range of from 0.25 to 33.3% of the hydroxyl groups have been converted into the corresponding alkali metal oxy groups, with an organic compound comprising a hydrocarbyl chain having a molecular weight of at least 150 and wherein said chain carries an electrophilic functional group, at a temperature in the range of from 20° to 150° C.

The reaction of alkali metal cellulosates, prepared by treating cellulosic materials with sodium in the presence of liquid ammonia, with esterifying agents such as $C_2$–$C_4$ acyl halides, is known from U.S. Pat. No. 2,181,906. The reference focuses on the reaction with acetyl chloride, and it cannot be concluded that the disclosed method is also suitable for esterifying considerably higher molecular weight compounds having an acyl halide or anhydride group. No information is provided nor is it obvious that esterification may also be effected for the preparation of hydrocarbyl chain-grafted cellulose fibers, wherein the grafts are derived from compounds having a considerably higher molecular weight than that of the disclosed acyl halides and anhydrides.

In the process of the present invention sodium cellulose groups are the preferred alkali metal cellulosate groups.

Although any method wherein the fiber structure of the cellulose material is maintained may be used for the introduction of alkali metal cellulosate groups, there is a preference for preparing the cellulosate group-containing cellulose fibers following a method as has been described by Y. Avny and L. Rebenfeld in Textile Research Journal 38, 1968 (599–605), which comprises the reaction of fibrous cellulose and an alkali metal methoxide.

The nature of the electrophilic functional group-carrying hydrocarbyl chains which are contacted with the alkali metal cellulosate group-containing cellulose fibers, is not critical, provided the electrophilic functional group has the ability to react with the cellulosate groups. The electrophilic functional groups may be selected from the group comprising: carboxy, anhydride, epoxy, acyl halide, sulfo, halide, halo silane and isocyanate groups. When the electrophilic group is an anhydride group, there is a preference for it being a cyclic anhydride group.

Some of the relatively low molecular weight suitable compounds such as hydrocarbyl compounds carrying an electrophilic functional group, which may be employed in the process of the present invention, are commercial products and include aliphatic carboxylic acids such as stearic acid and acyl chlorides such as lauroyl chloride, as well as aliphatic monoepoxides, which can be prepared e.g., via reaction of e.g., $C_{12}$ or $C_{14}$ monoolefins, preferably, $\alpha$-olefins, and a hydroperoxide, as described in U.S. Pat. No. 3,351,635.

Suitable starting materials for the preparation of other such hydrocarbyl compounds carrying an electrophilic functional group, e.g. higher molecular weight hydrocarbyl compounds carrying such a functional group, may be selected from the group of hydrocarbyl polymers having at least one reactive site per polymer chain. It is preferred that the reactive site be situated at the polymer chain end, and have the ability to be converted into an electrophilic functional group or be capable of having an electrophilic functional group attached to it. Suitable reactive site-carrying polymer chains include polymer chains prepared via an anionic polymerization process and which carry a living organometallic group. Lithium is a metal frequently used in the anionic polymerization. Other metals however, such as the other alkali metals and the alkaline earth metals, may also be used in this anionic polymerization process, and result in the corresponding organometallic group containing polymers.

As mentioned hereinbefore the organometallic groups can be effected to attach an electrophilic functional group onto the polymer chain. One method for attaching a carboxy group onto a living lithium terminated polymer chain has been described by R. P. Quirk and Wei-Chih Chen in Makromol. Chem. 183, (1982) 2071. The obtained carboxy group may subsequently, if required, be converted into an acyl chloride group by reaction with thionyl chloride. The organometallic groups can, however also be used to introduce other electrophilic functional groups. The use of an anionic polymerization has the additional advantage in that the molecular weight of the ultimate polymer species can be well controlled. Suitable polymer chains carrying an organometallic group and prepared via anionic polymerization for use in the present invention include polyalkylene arene and homo- and copolymer chains as well as polyalkylene arene-poly(conjugated)alkadiene block copolymer chains. Preferred anionically polymerized polymer chains are polystyrene homopolymer and polystyrene-polybutadiene block copolymer chains.

An alternative class of polymers which may be used as a starting material in the preparation of the functional group-carrying hydrocarbyl compounds, are hydrocarbyl polymer chains having at least one reactive monoolefinically unsaturated group per polymer chain. The monoolefinically unsaturated group may be used to introduce an electrophilic functional group. Suitable polymers for use in the present invention include polyalkylene homo- and copolymers having a monoolefinically unsaturated group. Polyisobutylene is a preferred polyalkylene homopolymer. One method to introduce a functional group of this type, i.e., an epoxy group, has been described in the hereinbefore cited U.S. Pat. No. 3,351,635. The olefinically unsaturated group may also be used to introduce a cyclic anhydride group by reaction with maleic anhydride such as has been described in United Kingdom patent specification No. 1,543,039, which method is directed to the reaction of polyisobutylene (PIB) with maleic anhydride (MALA). It will be understood by those skilled in the art that this method will also be applicable to other types of polymer species having a single olefinically unsaturated group and result in the corresponding polymer chain having substituted succinic anhydride or succinic acid. A further method for introducing a functional group via the olefinically unsaturated group is via the well-known addition of a hydrogen halide, such as hydrogen chloride.

The preparation of the hydrocarbyl chain-grafted cellulose fibers according to the process of the present invention, is important in that throughout the preparation the fibrous structure of the cellulose have product should be maintained, in order to arrive at the hydrocarbonyl chain-grafted cellulose fibers. As excessive heating is detrimental for the fibrous structure, it is preferred to carry out the preparation at a temperature in the range of from 50° C. to 90° C. Furthermore, it is vital that the reaction is carried out in the absence of a compound which has the ability to dissolve the cellulose fibers, as this would result in an irrevocable disappearance of the fiber structure. It may however, be beneficial to have a so-called swelling agent present in the process of the present invention, i.e. a compound which can be absorbed by the fibrous material and at a later stage released therefrom without disintegrating the fiber structure thereof. Suitable compounds, which should make the cellulosate groups more accessible in this process, include dimethylformamide and dimethyl sulfoxide.

Although the reaction between the cellulosate group-containing cellulose fibers and the electrophilic functional group-carrying hydrocarbyl chains may be conducted in the melt, there is a preference to contact the cellulose fibers with a solution of the organic compound comprising a hydrocarbyl chain carrying an electrophilic functional group. Aliphatic, cycloaliphatic, and aromatic hydrocarbons such as cyclohexane, toluene, and the xylenes, as well as cyclic ethers such as tetrahydrofuran or mixtures thereof may conveniently be used to prepare these essentially organic solutions.

The process of the present invention may conveniently be carried out with functional group-carrying hydrocarbyl chains having a molecular weight in the range of from 150 to 10,000, and more preferably, in the range of from 150 to 3000.

The average number of hydrocarbyl chains present per anhydroglucose unit (AGU) of the ultimate grafted cellulose fibers, i.e. the degree of substitution (DS) will to a large extent be determined by the molecular weight of the hydrocarbyl chain carrying the electrophilic functional group. Generally, the DS will be in the range of from 0.05 to 1.0, which result may sometimes be obtained only after a considerably long reaction time.

The hereinbefore mentioned hydrocarbyl-grafted cellulose fibers may be used for a number of applications. One potential use is in cellulose fibers and/or fabrics having increased oil absorbency. This property may be obtained by modifying cellulose fibers with a relatively large number of low molecular weight hydrocarbyl grafts per AGU. An alternative outlet may be formed as reinforcing fibers for thermoplastic polymer matrices. For this application hydrocarbyl-grafted cellulose fibers may be employed wherein the hydrocarbyl graft is fully compatible, both chemically and physically, with the polymer matrix and wherein hydrocarbyl grafts are present in relatively low concentrations.

The invention will be further illustrated by the following examples.

PREPARATION OF SODIUM CELLULOSATE GROUP-CONTAINING CELLULOSE FIBERS

Pretreatment of Fibers

A cellulose fibrous material (Whatman CF 11, a fiber grade for chromatography) was dried in a vacuum oven at 105° C. 1 G of dried cellulose fibrous material was stirred at ambient temperature in 10 ml of a 20%w aqueous sodium hydroxide solution for 15 minutes. After filtration, the fibers were washed with methanol until washings reacted neutral to litmus. The sodium content was found to be on average 0.5 meq/g.

Cellulosate Group Introduction

1 G of the above pretreated fibrous material was added to 50 ml of a 1N solution of sodium methoxide in methanol. The mixture was stirred at 25° C. for approximately 30 min. The excess sodium methoxide and methanol were removed by filtration, and the fibrous material was washed, 3 times with 20 ml of dimethyl sulfoxide and toluene respectively. The cellulose was found to contain 4.2 meq of sodium cellulosate per gram, which corresponds with a DS of 0.7. A similar product having a DS if 0.75 was also prepared.

EXAMPLES I–III

Preparation of Lauroyl Cellulosate Group-Containing Cellulose Fibers

1 G of the hereinbefore described sodium cellulosate group-containing fibers was contacted at 60° C. for 20 hours wit 50 ml of toluene, and lauroyl chloride in an amount as indicated in Table 1 hereinafter. Subsequently, the mixture was filtered and washed, three times, with 20 ml of each of the following liquids, toluene, ethanol and 1.0N HCl, followed by drying at 50° C. The resulting degree of lauroyl substitution, as calculated from the weight increase of the starting cellulose fibers, is given in Table 1.

TABLE 1

| Example | Lauroyl chloride, mmol/mmol AGU | DS | Structure |
|---|---|---|---|
| I | 0.68 | 0.3 | fibrous |
| II | 2.75 | 0.6 | fibrous |
| III | 4.05 | 1.0* | fibrous |

*indicates that some esterifications with hydroxyl groups has also occurred.

EXAMPLES IV–X

Preparation of Polyisobutylene Succinoyl Cellulosate Group-Containing Cellulose Fibers 10 G of sodium cellulosate group-containing cellulose fibers, prepared as hereinbefore described (DS 0.7) was contacted with a PIB-MALA solution (100 g PIB-MALA in 200 ml toluene) in such a ratio and under the conditions as indicated in Table 2 hereinafter. Subsequently, the fibers were separated by filtration, washed, (twice with 100 ml each of toluene and ethanol and four times with 100 ml of 1N HCl). The residue was further extracted for 20 hours with cyclohexane in a Soxhlet apparatus and finally dried at 70° C. under vacuum. The degree of substitution is also given in Table 2. In each of the Examples, a fibrous product structure was obtained.

TABLE 2

| Example | Mol ratio of PIB MALA to AGU | Mol wt PIB MALA | Temperature °C. | Time h | Grafting* % | DS |
|---|---|---|---|---|---|---|
| IV | 1:1 | 1000 | 80 | 68 | 35 | 0.053 |
| V | 1:1.5 | 1000 | 80 | 68 | 50 | 0.075 |
| VI | 1:2 | 1000 | 60 | 68 | 75 | 0.113 |
| VII | 1:2 | 1000 | 80 | 18 | 35 | 0.053 |
| VIII | 1:2 | 1000 | 80 | 68 | 92 | 0.153 |
| IX | 1:2 | 1000 | 80 | 116 | 113 | 0.188 |
| X | 1:2 | 2000 | 80 | 130 | 50 | 0.03 |

*Percent grafting is the weight increase as a result of grafting expressed as a percentage of starting weight of cellulose

EXAMPLE XI

Preparation of Hydroxytetradecyl Cellulose Fibers

To 1 g of sodium cellulosate group-containing fibers having a DS 0.75, as described hereinbefore, was added 50 ml of toluene and 5 g of a $C_{14}$ epoxidized α-olefin (a commercial product, ex Degussa, W. Germany). After heating at 60° C. for 14 hours, the mixture was filtered and washed, three times with 20 ml of each of the following liquids, toluene, ethanol and 1N HCl. The reaction product was dried in vacuum at 50° C. Based on the weight increase of the cellulose fibers, the DS was calculated to be 0.14.

What is claimed is:

1. A process for the preparation of hydrocarbyl chain-grafted cellulose fibers, which process comprises:

(a) contacting pre-treated cellulose fibers having attached hydroxyl groups, said pre-treated fibers being obtained by contacting cellulose fibers with aqueous sodium hydroxide, with an alkali metal methoxide in the presence of methanol, thereby converting between about 0.25 to 33.3% of the hydroxyl groups into the corresponding alkali metal oxy groups, and (b) contacting the resulting product with an organic compound comprising a hydrocarbyl chain having a molecular weight of at least 150 and wherein said chain carries an electrophilic functional group, at a temperature in the range of from 20° to 150° C.

2. The process according to claim 1, wherein the alkali metal oxy group is a sodium oxy group.

3. The process according to claim 1, wherein the electrophilic functional group is selected from the group comprising carboxy, anhydride, epoxy, acyl halide, sulfo, halide, halo silane and isocyanate groups.

4. The process according to claim 3, wherein the anhydride group is a cyclic anhydride group.

5. The process according to claim 1, wherein the hydrocarbyl chain is a polyalkylene arene homopolymer or copolymer chain or a polyalkylene arene-poly(-conjugated)-alkadiene block copolymer chain.

6. The process according to claim 5, wherein the polyalkylene arene homopolymer chain is a polystyrene chain.

7. The process according to claim 5, wherein the polyalkylene arene-poly(conjugated)alkadiene block copolymer chain is a polystyrene-polybutadiene block copolymer chain.

8. The process according to claim 1, wherein the hydrocarbyl chain is a polyalkylene homopolymer or copolymer chain.

9. The process according to claim 8, wherein the polyalkylene homopolymer chain is a polyisobutylene polymer chain.

10. The process according to claim 1, wherein the temperature is in the range of from 50° to 90° C.

11. The process according to claim 1, wherein the hydrocarbyl chains have a molecular weight in the range of from 150 to 10,000.

12. The process according to claim 11, wherein the molecular weight is in the range of from 150 to 3000.

13. The process according to claim 1, wherein the degree of substitution of the hydrocarbyl chain-grafted cellulose fibers is in the range of from 0.05 to 1.0.

14. Thermoplastic polymer matrices comprising hydrocarbyl chain-grafted cellulose fibers, prepared by contacting pre-treated cellulose fibers, wherein between about 0.25 to 33.3% of the hydroxyl groups have been converted into the corresponding alkali metal oxy groups, with an organic compound comprising a hydrocarbyl chain having a molecular weight of at least 150 and wherein said chain carries an electrophylic functional group, at a temperature in the range of from 20° to 150° C.

15. The matrices of claim 14, wherein said matrices further comprise additional reinforcement by hydrocarbyl chain-grafted cellulose fibers contacting pre-treated cellulose fibers, wherein between about 0.25 to 33.3% of the hydroxyl groups have been converted into the corresponding alkali metal oxy groups, with an organic compound comprising a hydrocarbyl chain having a molecular weight of at least 150 and wherein said chain carries an electrophylic functional group, at a temperature in the range of from 20° to 150° C.

* * * * *